US005283597A

United States Patent [19]

Yoshida et al.

[11] Patent Number: 5,283,597

[45] Date of Patent: Feb. 1, 1994

[54] LASER BEAM PRINTER WITH AUTOMATIC LASER BEAM CONTROL

[75] Inventors: Shinji Yoshida; Makoto Ohneda, both of Saitama, Japan

[73] Assignee: Fuji Xerox Co., Ltd., Tokyo, Japan

[21] Appl. No.: 883,963

[22] Filed: May 15, 1992

[30] Foreign Application Priority Data

May 17, 1991 [JP] Japan ..... 3-141198

[51] Int. Cl.[5] ..... G03G 15/00

[52] U.S. Cl. ..... 346/108; 355/206

[58] Field of Search ..... 355/203, 206, 210, 260; 346/108, 160, 160.1

[56] References Cited

U.S. PATENT DOCUMENTS 4,943,815 7/1990 Aldrich et al. ..... 346/108
4,961,088 10/1990 Gilliland et al. ..... 355/206
4,963,939 10/1990 Kurando et al. ..... 355/260

FOREIGN PATENT DOCUMENTS 0261643 3/1988 European Pat. Off. .
0395320 10/1990 European Pat. Off. .
2234467A 2/1991 United Kingdom .

*Primary Examiner*—Joan H. Pendegrass
*Attorney, Agent, or Firm*—Finnegan, Henderson, Farabow, Garrett & Dunner

[57] ABSTRACT

A memory storing the frequency of using a laser beam printer is attached to a consumable part of the printer. Data indicating its expandable part is stored at the memory location of a specific address of the memory. When the consumable part is set to the laser beam printer, the data is read out of the memory. Emission of the laser beam is prohibited unless the data is read out. When the intended data is readout, control knows that the consumable part has been set to the printer. When the consumable part is properly set, it perfectly shuts off laser beams dangerous for an operator. Under this condition, emission of laser beams is permitted. In this way, the operator is protected from laser beams.

4 Claims, 4 Drawing Sheets

LASER BEAM PRINTER WITH AUTOMATIC LASER BEAM CONTROL

BACKGROUND OF THE INVENTION

The present invention relates to a laser beam printer capable of protecting an operator from being exposed to laser beams. FIG. 3 is a sectional view showing the construction of a key portion of a laser beam printer. In FIG. 3, reference numeral 4 designates a laser scanner; 10, a photoreceptor drum cartridge; 10-1, a photoreceptor in the form of a drum; 11, a toner cartridge; 20, a laser beam printer; 21, a pop-up; 22, a fulcrum; and 23, a laser beam path.

A laser beam emitted by the laser scanner 4 travels along the laser beam path 23, and hits the surface of the photoreceptor 10-1, thereby forming a latent electrostatic image thereon. Toner supplied from the toner cartridge 11 is applied to the latent image, to form a toner image. The toner image is transferred to and fused on a recording paper, which is supplied along a paper path 24. The paper bearing the image is forwarded in the direction B, and discharged outside the laser beam printer.

The laser beam printer thus constructed uses consumable parts removably set or attached to the printer, such as the drum cartridge and the toner cartridge. Those parts are frequently removed from the printer body at the time of periodical inspection, replacement of old parts with new ones, repair for jamming, for example. In such a case, the pop-up 21 is raised.

The pop-up 21, which includes some parts of the printer structure, for example, the laser scanner 4, and the like, is upwardly swung about the fulcrum 22 in the direction A. After the pop-up 21 is raised, the inner structure of the laser beam printer is exposed to allow an operator or a serviceman to make an easy access to the inner structure for inspection and repair.

In a state that the printer is turned on, when the consumable part, such as the drum cartridge 10, is removed, the direct or reflected laser beam, which has been interrupted by some parts before removal of the consumable part, appears outside where it could possibly hit the operator. The laser beam is hazardous for the operator. When it hits the eyes of the operator, he may lose his eyesight. To avoid such a dangerous situation, a measure has been taken for shutting off the laser beam when the drum cartridge 10, for example, is removed.

FIG. 5 is a block diagram showing a key portion of the electrical arrangement of a conventional laser beam printer. In FIG. 5, reference numeral 1 indicates a laser-beam emission controller; 2, an interlock switch; 3, a power source; 4, a laser scanner; 5, a laser controller; 6, a CPU (central processing unit); 7, an I/0 (input/output) port; 8, a drum detect switch; 9, a toner detect switch; 10, a drum cartridge; and 11, a toner cartridge.

The interlock switch 2 is provided for checking whether or not the pop-up 21 has been returned to the normal position, and is lit on when the pop-up 21 is returned to the normal position. FIG. 4 is an explanatory diagram showing the on/off operation of the interlock switch 2. In the figure, reference numeral 2-1 designates a spring; 21-1, a pop-up cover; and 21-2, a projection. When the pop-up 21 is at the normal position, the projection 21-2 pushes down the interlock switch 2. When the pop-up 21 is turned in the direction A shown in FIG. 3, the projection 21-2 is apart from the interlock switch 2. The interlock switch 2 is pulled up by the spring 2-1, so that it is turned off. When the switch 2 is turned on (that is, the pop-up 21 is returned to the normal position), electric power is supplied from the power source 3 to the laser controller 5.

The laser controller 5, although power is supplied thereto, will not be operated until the drum cartridge 10 and the toner cartridge 11 are set to the printer. The setting of the cartridges 10 and 11 is detected by the drum detect switch 8 and the toner detect switch 9. The detection is transferred to the laser controller 5, through the I/O port 7 and the CPU 6. The drum detect switch 8 is a mechanical switch, which is turned on when the drum cartridge 10 has been set. The toner detect switch 9 is also a mechanical switch similarly operating.

When the cartridge is set to the printer, an earth voltage (corresponding to a low signal) is supplied to the I/O port 7. Accordingly, the setting of them can be detected through the check of the voltage supplied to the I/O port 7.

Thus, in the conventional laser beam printer, emission of the laser beam is prohibited until the drum cartridge 10 and the toner cartridge 11 as the parts located at the laser-beam shut-off place are set to the printer. Accordingly, the operators are protected from being exposed to laser beams.

As described above, in the conventional laser beam printer, the shut-off of the laser beam depends on the on/off o of the mechanical switch. During the repair and inspection of the printer after removal of the drum cartridge 10 and the like, the switch is often turned on mistakenly or any of other manner than the normal switching manner. In such a case, the operator will be exposed to dangerous laser beams.

During the inspection and repair, the switch is frequently turned on in a switching manner different from the normal switching manner. For example, when a bar shaped like the projection 21-2, already prepared, is applied to the switch (see FIG. 4), the switch is turned on. When the switch is turned on in this way and the laser emitting condition is unexpectedly set up, the laser beams will hit the operator. To solve the problem of the exposure of the operation to dangerous laser beams, the present invention is made.

SUMMARY OF THE INVENTION

To solve the above problem, there is provided a laser beam printer of type in which a consumable unit with a memory is removably set to the laser beam printer, wherein data indicating the consumable part is stored at a specific memory location of the memory, emission of laser beams is prohibited until the consumable part is set to the laser beam printer and the data is read out of the memory.

Some types of the consumable parts removably attached to the laser beam printer include each a memory for storing the frequency of using the printer. The memory stores data indicating its consumable part at a memory location of a specific address. When the consumable part is set to the printer, the data is read out of the memory. The emission of the laser beam is prohibited unless the data is read out of the memory.

When the intended data is read out, control knows that the consumable part has been set to a predetermined location of the printer. At this time, even if the laser beam is emitted, the laser beam is perfectly shut off by the consumable part already set thereto, and harmful laser beam will not reach the operator. Under this condition, control permits the emission of laser beams.

DETAILED DESCRIPTION OF THE PREFERRED EMBODIMENT

Figure 1:
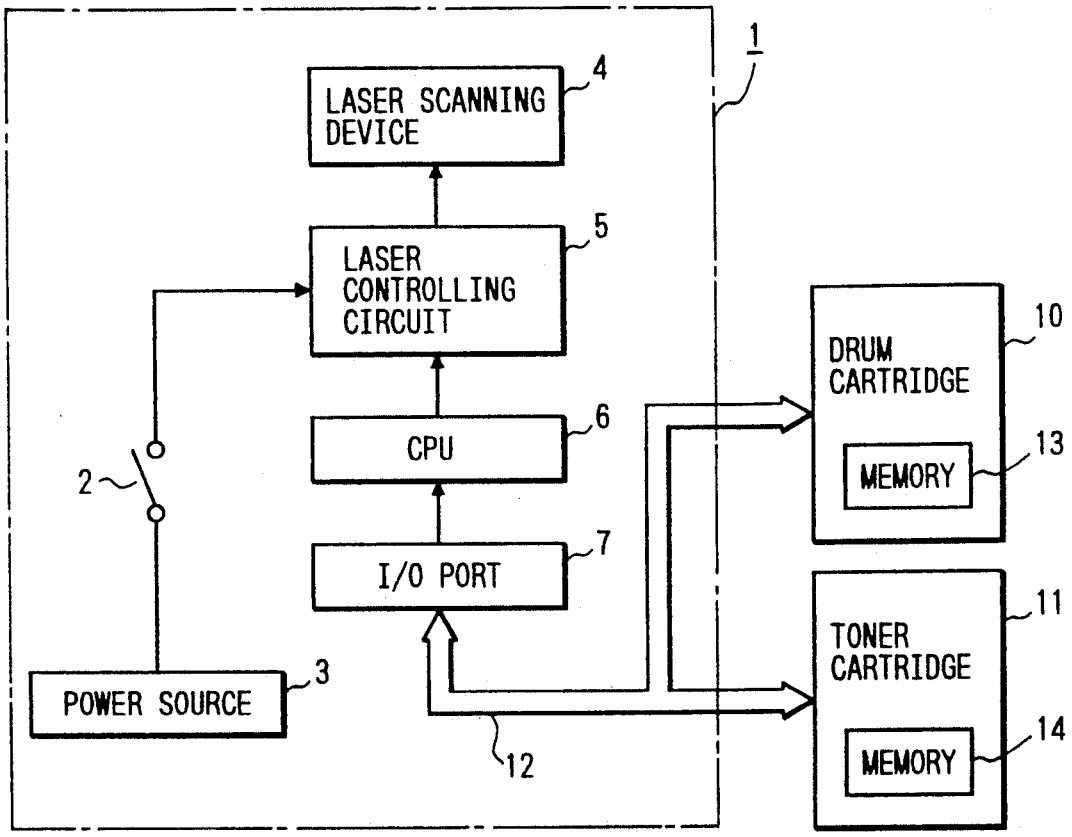
FIG. 1 is a block diagram showing a key portion of the electrical arrangement of a laser beam printer according to the preferred embodiment of the present invention.
Figure 5:
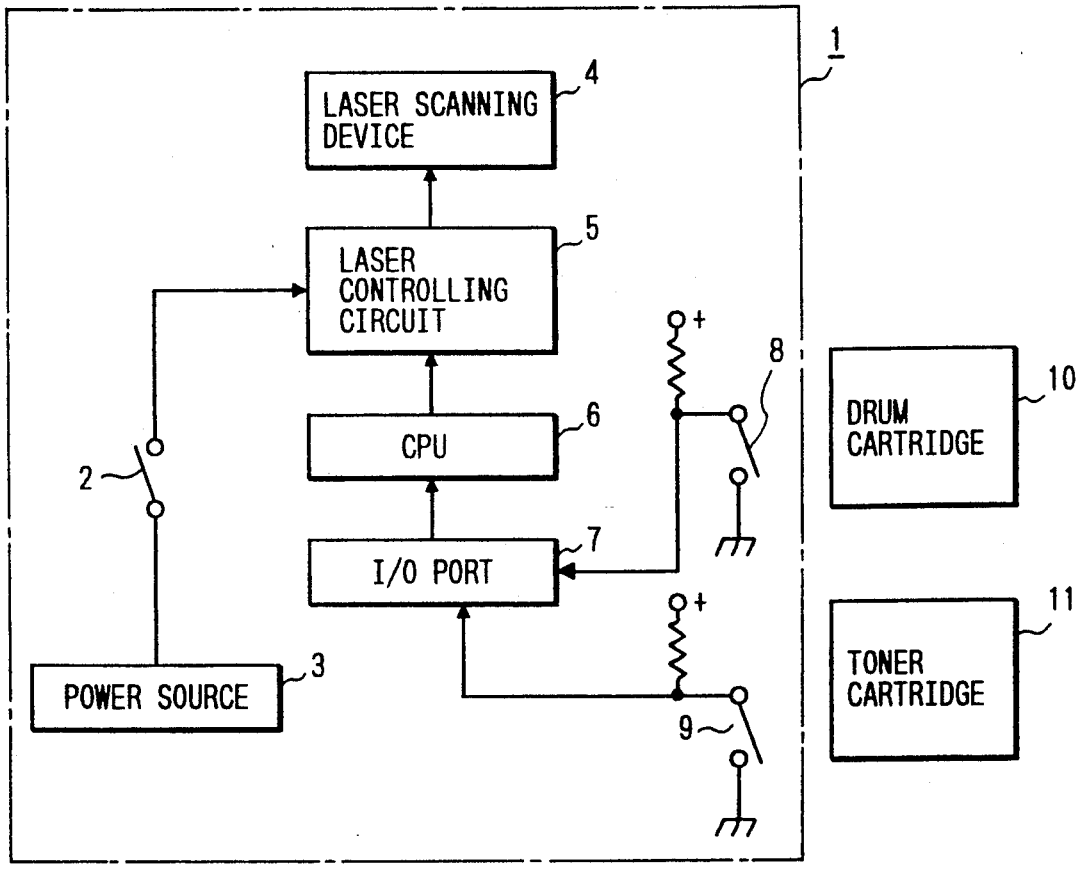
FIG. 5 is a block diagram showing a key portion of the electrical arrangement of a prior laser beam printer.

The preferred embodiment of the present invention will be described with reference to the accompanying drawings. FIG. 1 is a block diagram showing a key portion of the electrical arrangement of a laser beam printer according to the preferred embodiment of the present invention. In the figure, like reference numerals are used for designating like equivalent portions in FIG. 5. Reference numeral 12 designates a communication bus; 13, a memory provided in the drum cartridge 10; and 14, a memory provided in the toner cartridge 11. In this embodiment, the drum cartridge 10 and the toner cartridge 11 are used as the consumable parts concerning the leakage of laser beams. If any other related parts are contained, those are treated in a similar way.

To secure a satisfactory quality of print, those cartridges 10 and 11 are replaced with new ones when their lifetime is terminated, viz. when they are used 20,000 times. In one of the methods to check the lifetime, a memory storing the frequency of using the printer is contained in each consumable part, and control checks as to whether or not the lifetime is terminated, while referring to the content of the memory. Originally, the memories 13 and 14 are provided for the purposes of checking the lifetime termination of the cartridges.

In the present invention, those memories are also used for checking as to whether or not the consumable parts are attached to the printer. To this end, the memory of each consumable part stores data (like ID code) indicating its consumable part at a memory location of a specific address. The CPU 6 reads the data from the memory, and determines whether or not that consumable part has been attached.

The memory 13, for example, stores data indicating the drum cartridge 10 at a memory location of a specific address. When the drum cartridge 10 has been attached to a prescribed location of the printer, the CPU 6 reads the data from that memory location of the memory 13 through the communication bus 12, and determines on the basis of the read out data that the cartridge has been attached is the drum cartridge 10.

If the toner cartridge 11 is mistakenly set to the location of the printer, which is provided for the drum cartridge 10, the data indicating the drum cartridge 10 cannot be read out of the memory. In other words, the data read out is the data indicating the toner cartridge 11 because the toner cartridge 11 has the memory 14. In this case, the CPU determines that the cartridge has been improperly attached.

Figure 2:
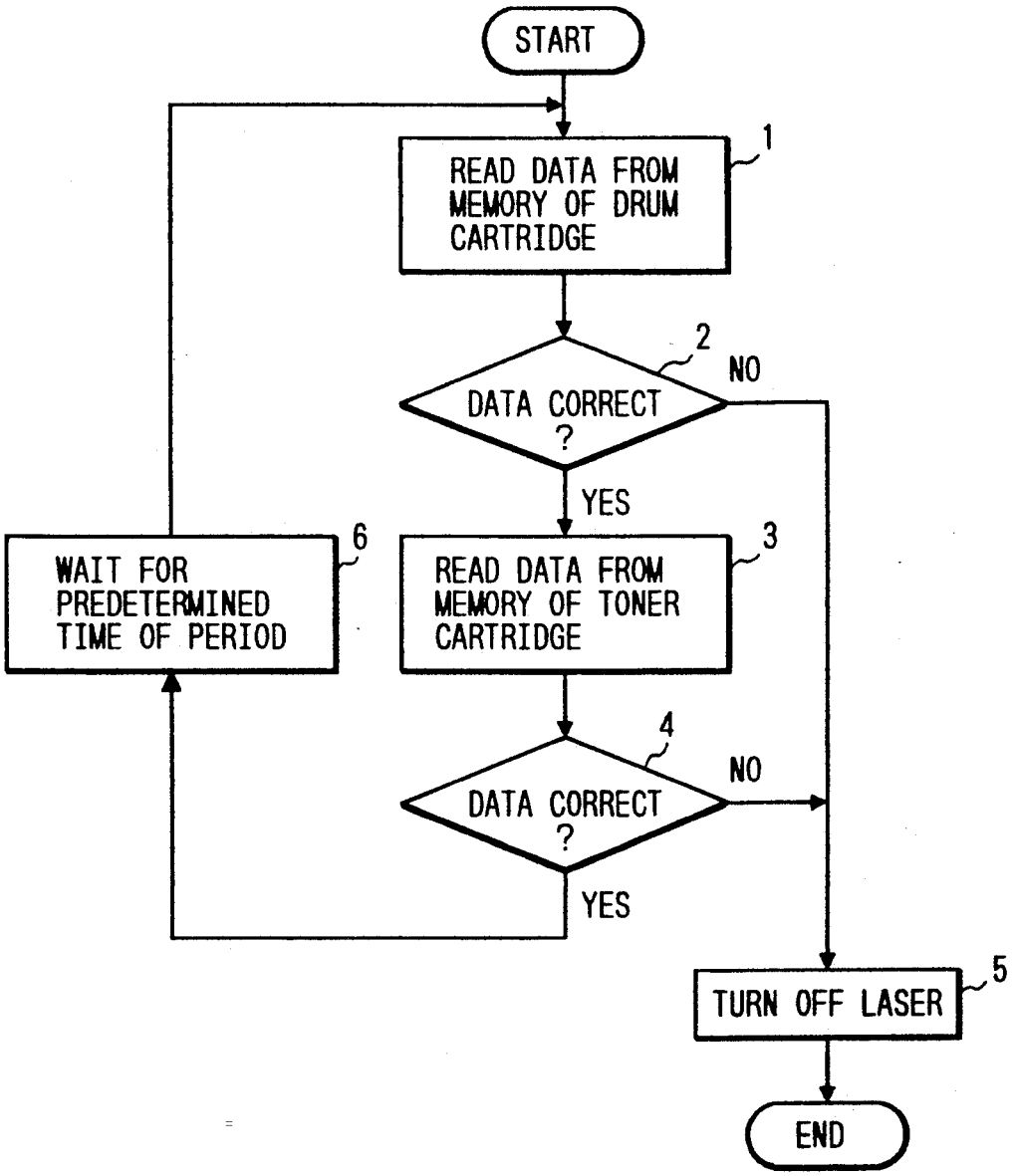
FIG. 2 is a flowchart for explaining the operation of the laser beam printer of the invention.
Figure 3:
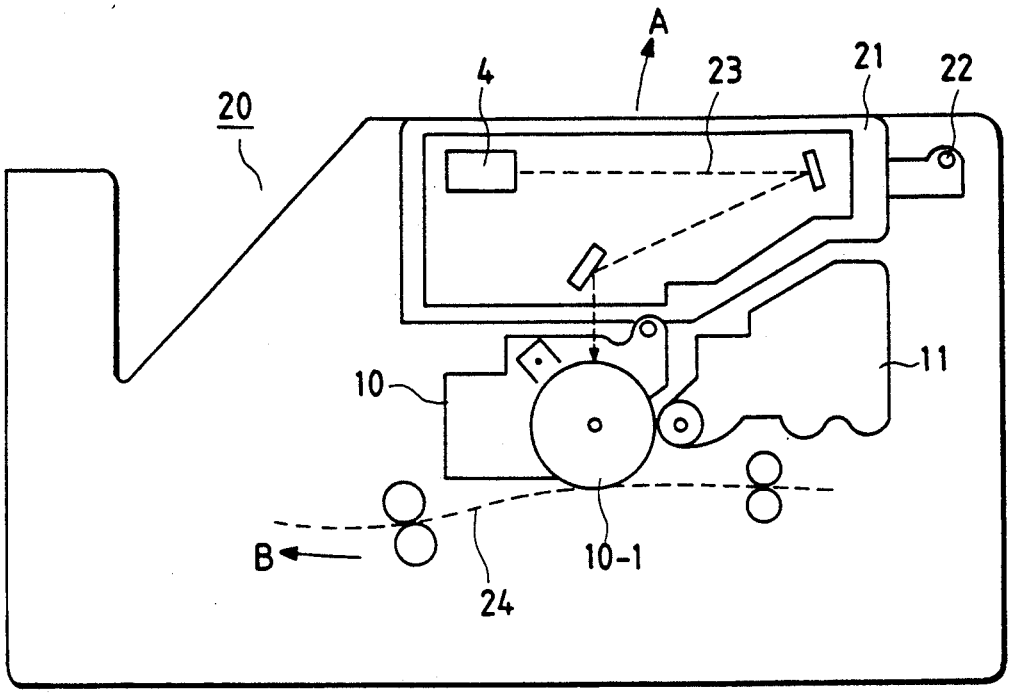
FIG. 3 is a sectional view showing the construction of a key portion of a prior laser beam printer.
Figure 4:
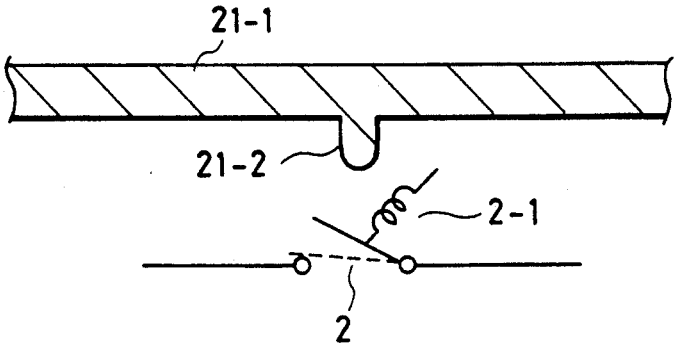
FIG. 4 is an explanatory diagram showing the on/off operation of an interlock switch.

FIG. 2 is a flowchart for explaining the operation of the laser beam printer of the invention. In the description given below, steps 1 to 6 correspond to steps 1 to 6 in the flowchart as follows: The CPU 6 reads the data at the memory location of a specific address in the memory 13 of the drum cartridge 10, through the communication bus 12 and the I/O port 7 (step 1); The CPU checks whether or not the read out data indicates the drum cartridge 10. A reference value for verifying the data is stored in the CPU 6. If the data does not indicate the drum cartridge 10, the CPU advances to step 5 to turn off the laser (step 2); The CPU reads the data at the memory location of a specific address in the memory 14 of the toner cartridge 11 (step 3); The CPU checks whether or not the read out data indicates the toner cartridge 11. A reference value for data verification is also stored in the CPU. If the data does not indicate the toner cartridge 11, the CPU advances to step 5 to turn off the laser (step 4).

The CPU advances to this step only when the drum cartridge 10 or the toner cartridge 11 has been properly attached (step 6). In this case, the CPU waits for a prescribed time and returns to step 1. This is because it periodically checks whether or not the cartridge has been attached. This is done for periodically checking whether or not the cartridge has been set to the printer. Otherwise, no measure can be taken for such a case where after the cartridge has been set, it is removed again.

As seen from the foregoing description, the setting of the consumable part is detected on the basis of the specific data read out of the memory contained in the consumable part that is set, not on/off of a mechanical switch. In other words, emission of the laser beam is permitted only when the data is read out. Thus, the present invention has succeeded in solving such a problem of the laser beam printer using the mechanical switch that the operator will be exposed to laser beams when the mechanical switch is operated mistakenly or in any of other manners than the normal manner.

Since the specific data is stored in the memory already used, little additional cost is required for realizing the present invention.

What is claimed is:

1. A laser beam printer comprising:

a laser beam source;

a consumable unit with a memory stored with data;

detecting means for repeatedly detecting whether or not said consumable unit is attached to said laser beam printer by performing a comparison of said data of said consumable unit with a predetermined data stored at said detecting means;

control means for controlling said laser beam printer in accordance with a signal generated by said detecting means in response to said comparison;

wherein said control means is operable in response to said signal to turn off said laser beam source if said consumable unit is not attached to said laser beam printer.

2. A laser beam printer as claimed in claim 1, wherein said data is stored at a specific memory location of said memory separate from a memory location of frequency of use data of said laser beam printer.

3. A laser beam printer as claimed in claim 1, wherein said data is transmitted by said control means through a communication bus.

4. A laser beam printer and a consumable unit with a memory assembly comprising:

a laser beam source;

detecting means for repeatedly detecting whether or not said consumable unit is attached to said laser beam printer by performing a comparison of data of said consumable unit with a predetermined data stored at said detecting means; and control means for controlling said laser beam printer in accordance with a signal generated by said detecting means in response to said comparison;

wherein said control means is operable in response to said signal to turn off said laser beam source if said consumable unit is not attached to said laser beam printer.

* * * * *